US009046265B2

(12) United States Patent
Buss et al.

(10) Patent No.: US 9,046,265 B2
(45) Date of Patent: Jun. 2, 2015

(54) REHEAT BURNER

(75) Inventors: Johannes Buss, Hohberg (DE); Andrea Ciani, Zürich (CH); Urs Benz, Gipf-Oberfrick (CH); Michael Düsing, Rheinfelden (DE); Michael Hutapea, Baden (CH); Adnan Eroglu, Untersiggenthal (CH)

(73) Assignee: ALSTOM TECHNOLOGY LTD, Baden (CH)

( * ) Notice: Subject to any disclaimer, the term of this patent is extended or adjusted under 35 U.S.C. 154(b) by 960 days.

(21) Appl. No.: 13/205,146

(22) Filed: Aug. 8, 2011

(65) Prior Publication Data

US 2012/0047901 A1 Mar. 1, 2012

(30) Foreign Application Priority Data

Aug. 16, 2010 (EP) ..... 10172900

(51) Int. Cl.

| | |
|---|---|
| ***F23R 3/12*** | (2006.01) |
| ***F23R 3/20*** | (2006.01) |
| ***F23D 11/40*** | (2006.01) |
| ***F23C 3/00*** | (2006.01) |
| ***F23R 3/00*** | (2006.01) |

(52) U.S. Cl.

CPC ..... *F23D 11/402* (2013.01); *F23R 3/002* (2013.01); *F23R 3/12* (2013.01); *F23R 2900/03341* (2013.01); *F23C 3/002* (2013.01); *F23D 11/408* (2013.01); *F23R 3/20* (2013.01)

(58) Field of Classification Search

CPC .. F23R 2900/03341; F23R 3/002; F23R 3/04; F23R 3/12; F23C 2900/07002; F23C 2900/07021; F02C 6/003

USPC ..... 60/751–760, 774, 791, 39.17

See application file for complete search history.

(56) References Cited

U.S. PATENT DOCUMENTS

| | | | | |
|---|---|---|---|---|
| 3,082,603 | A * | 3/1963 | Hering et al. | 60/752 |
| 5,060,867 | A | 10/1991 | Luxton et al. | |
| 5,673,551 | A * | 10/1997 | Dobbeling | 60/776 |
| 2002/0187448 | A1 * | 12/2002 | Eroglu et al. | 431/350 |
| 2006/0035183 | A1 | 2/2006 | Carroni et al. | |
| 2010/0236246 | A1 | 9/2010 | Buss et al. | |

FOREIGN PATENT DOCUMENTS

| | | | |
|---|---|---|---|
| DE | 100 26 122 | A1 | 11/2001 |
| EP | 0 287 392 | A2 | 10/1988 |
| EP | 2 199 674 | A1 | 6/2010 |
| EP | 2 211 109 | A1 | 7/2010 |
| GB | 2 398 375 | A | 8/2004 |

OTHER PUBLICATIONS

European Search Report dated Mar. 25, 2011.

* cited by examiner

*Primary Examiner* — Phutthiwat Wongwian
*Assistant Examiner* — William Breazeal
(74) *Attorney, Agent, or Firm* — Buchanan Ingersoll & Rooney PC

(57) ABSTRACT

A reheat burner includes a channel with a lance projecting thereinto to inject a fuel over an injection plane perpendicular to a channel longitudinal axis. The channel and lance define a vortex generation zone upstream of the injection plane and a mixing zone downstream of the injection plane in the hot gas direction. The mixing zone has a cross section with diverging side walls in the hot gas direction. The diverging side walls define curved surfaces in the hot gas direction having a constant radius.

15 Claims, 3 Drawing Sheets

REHEAT BURNER

RELATED APPLICATION

This application claims priority under 35 U.S.C. §119 to European Patent Application No. 10172900.2 filed in Europe on Aug. 16, 2010, the entire content of which is hereby incorporated by reference in its entirety.

FIELD

The present disclosure relates to a reheat burner.

BACKGROUND INFORMATION

Known sequential combustion gas turbines can include a first burner, wherein a fuel is injected into a compressed air stream to be combusted and generate hot gases that are partially expanded in a high pressure turbine.

The hot gases coming from the high pressure turbine are then fed into a reheat burner. Fuel is injected into the reheat burner to be mixed and combusted in a downstream combustion chamber. The hot gases generated are then expanded in a low pressure turbine.

FIGS. 1-3 show an example of a known reheat burner.

With reference to FIGS. 1-3, known burners 1 can have a quadrangular channel 2 with a lance 3 housed therein.

The lance 3 has nozzles from which a fuel (for example, gaseous fuel or liquid fuel, such as oil) can be injected. As shown in FIG. 1, the fuel can be injected over a plane known as an injection plane 4.

A channel zone upstream of the injection plane 4 (in the direction of the hot gases G) is a vortex generation zone 6. In this zone vortex generators 7 are housed, projecting from walls of the channel 2 to induce vortices and turbulence into the hot gases G.

A channel zone downstream of the injection plane 4 (in the hot gas direction G) is a mixing zone 9. This zone has plane, diverging side walls 10, and defines a diffuser with an opening angle A relative to a channel longitudinal axis typically below 7 degrees, to avoid flow separation from an inner surface of the side walls 10.

As shown in the figures, over a total channel length, the side walls 10 of the channel 2 may converge or diverge to define a variable burner width w (measured at mid-height), whereas the top and bottom walls 11 of the channel 2 can be parallel to each other, to define a constant burner height h.

The structure of the burner 1 is arranged in order to achieve a compromise of hot gas velocity and vortices and turbulence within the channel 2 at the design temperature.

A high hot gas velocity through the burner channel 2 can reduce $NO_x$ emissions (because the residence time of burning fuel in the combustion chamber 12 downstream of the burner 1 can be reduced) and increases the flashback margin (because it can reduce the residence time of the fuel within the channel 2 making it more difficult for the fuel to achieve auto ignition) and can reduce water consumption in oil operation (water is mixed with oil to reduce the likelihood of flashback).

In contrast, high hot gas velocity can increase the CO emissions (because the residence time in the combustion chamber 12 downstream of the burner 1 is low) and pressure drop and increase efficiency and achievable power.

In addition, a high vortex and turbulence degree can reduce the $NO_x$ and CO emissions (due to good mixing), but can increase the pressure drop and reduce efficiency and achievable power.

In order to increase the gas turbine efficiency and performances, the temperature of the hot gases circulating through the reheat burner 1 can be increased.

Such an increase causes the equilibrium among all the parameters to be missed, such that a reheat burner, operating with hot gases having a higher temperature than the design temperature, may have flashback, $NO_x$, CO emissions, water consumption and pressure drop problems.

SUMMARY

A reheat burner is disclosed, comprising a channel; a lance projecting into the channel for injecting a fuel over an injection plane perpendicular to a channel longitudinal axis, wherein the channel and lance define a vortex generation zone upstream of the injection plane and a mixing zone downstream of the injection plane in a hot gas direction, wherein at least the mixing zone has a cross section with diverging side walls in a hot gas direction, and the diverging side walls define curved surfaces in the hot gas direction having a constant radius.

A reheat burner is disclosed, comprising a channel having a longitudinal axis, means for injecting fuel into the channel over an injection plane perpendicular to the channel longitudinal axis, wherein the channel and the means for injecting fuel define a vortex generation zone upstream of the injection plane and a mixing zone downstream of the injection plane in the hot gas direction, wherein at least the mixing zone has a means for decreasing a hot gas velocity in the channel for increasing a fuel/hot gas mixture residence time in a combustion chamber.

BRIEF DESCRIPTION OF THE DRAWINGS

Further, characteristics and advantages of the disclosure will be more apparent from the description of exemplary embodiments of the reheat burner, illustrated by way of non-limiting example in the accompanying drawings, in which.

DETAILED DESCRIPTION

The disclosure provides exemplary embodiments of reheat burners that may safely operate without incurring in or with limited risks of flashback, $NO_x$, CO emissions, water consumption and pressure drop problems, for example, when operating with hot gases having a temperatures higher than in known burners.

Figure 1:
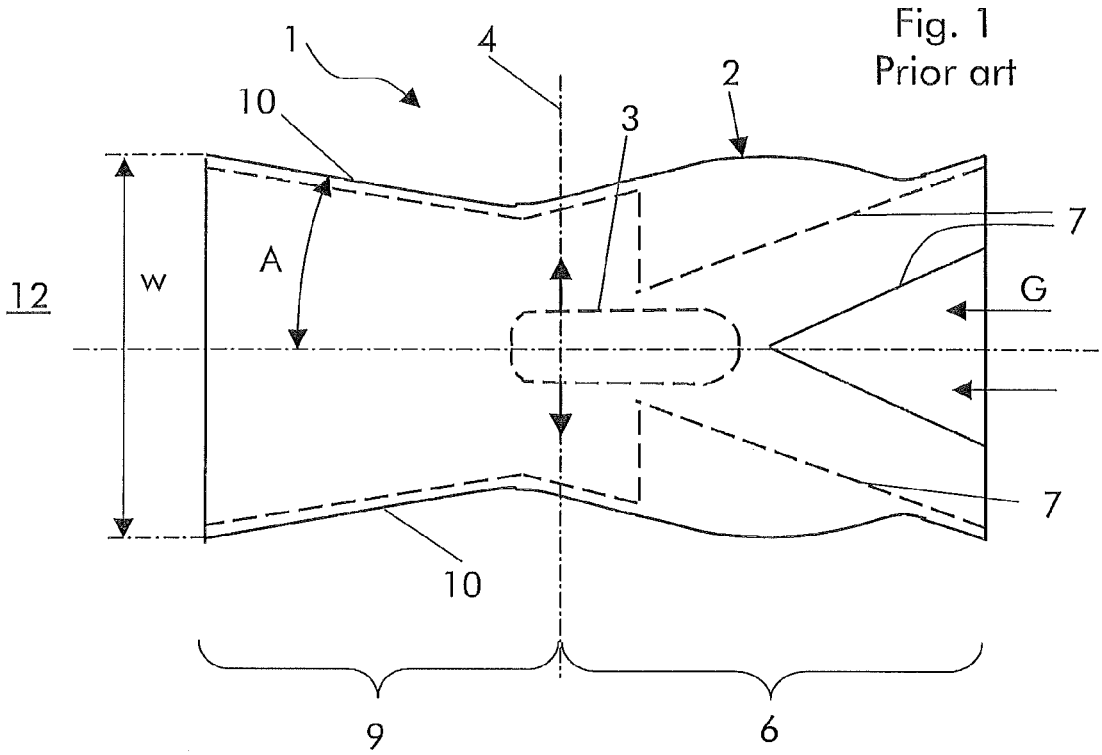
Fig. 1 Prior art
FIGS. 1, 2 and 3 are respectively a top view, a side view and a front view of a known reheat burner.
Figure 2:
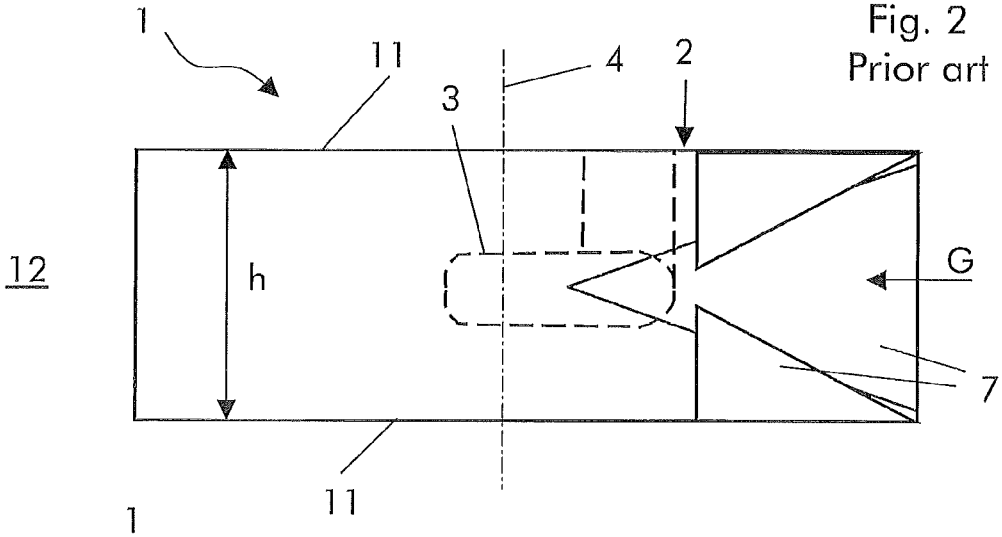
Fig. 2 Prior art
Figure 3:
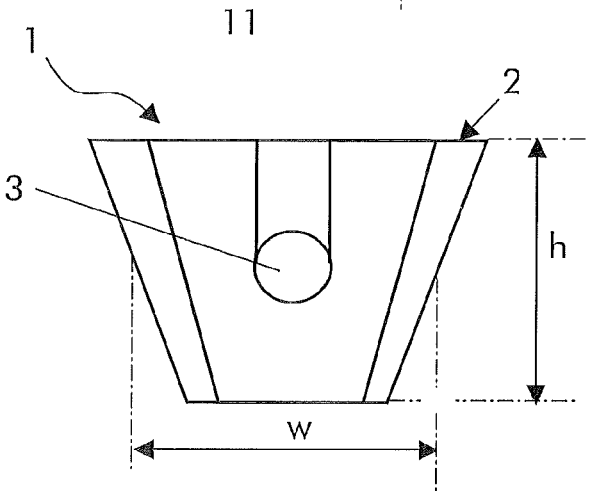
Fig. 3 Prior art
Figure 4:
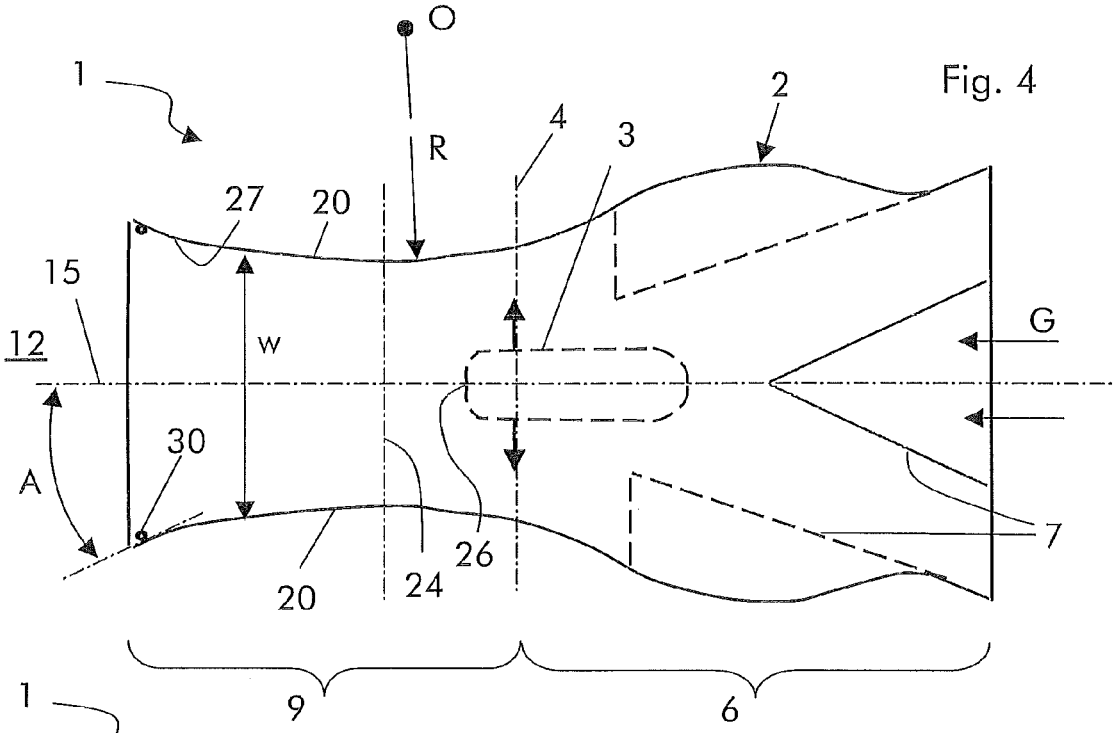
FIGS. 4, 5 and 6 are respectively a top view, a side view and a front view of a reheat burner in an exemplary embodiment of the disclosure.
Figure 5:
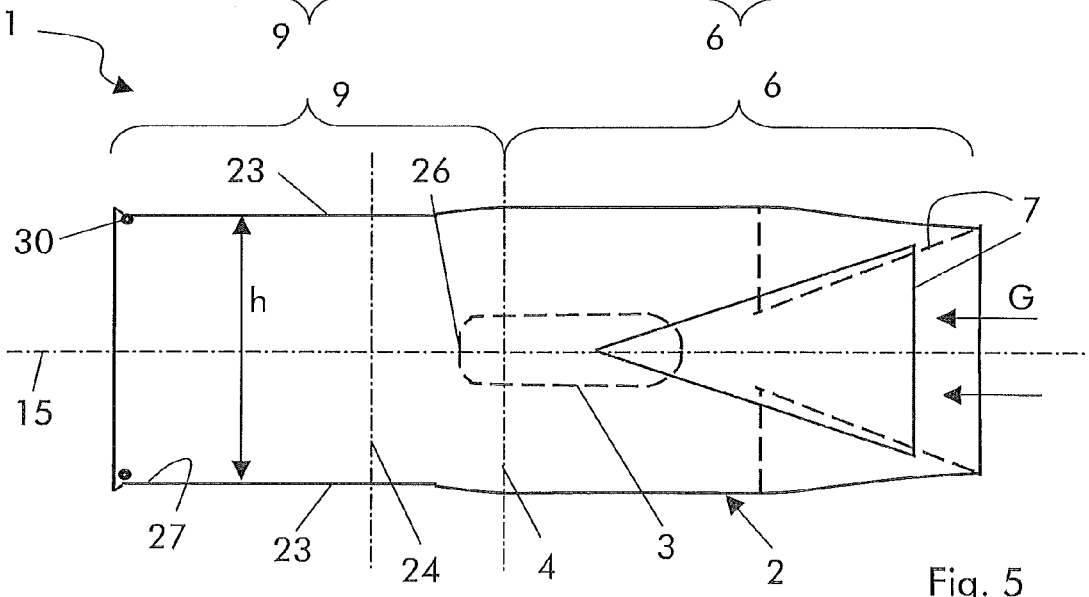
Figure 6:
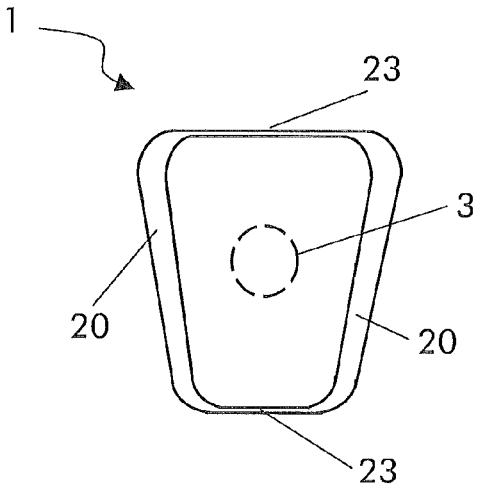

With reference to FIGS. 4, 5 and 6, an exemplary embodiment of a reheat burner 1 is illustrated, wherein like reference numerals designate identical or corresponding parts throughout the several views.

The reheat burner 1 includes a channel 2 with a quadrangular, square or trapezoidal cross section.

The channel 2 has a lance 3 projecting therein to inject a fuel over an injection plane 4 substantially perpendicular (e.g., ±10%) to a channel longitudinal axis 15.

The channel 2 and lance 3 can define a vortex generation zone 6 upstream of the injection plane 4 and a mixing zone 9 downstream of the injection plane 4 in the hot gas G direction.

The mixing zone 9 can have a quadrangular or trapezoidal or square cross section with diverging side walls 20 in the hot gas G direction.

The diverging side walls 20 can define curved surfaces in the hot gas G direction with a constant (e.g., substantially constant, such as ±10%) radius R centered at O.

The diverging side walls 20 can define the curved surfaces with the constant radius R in the hot gas G direction.

The diverging side walls 20 may extend defining an angle A between their end and an axis 15 larger than, for example, 8 degrees and up to 15 degrees or more.

Figure 7:
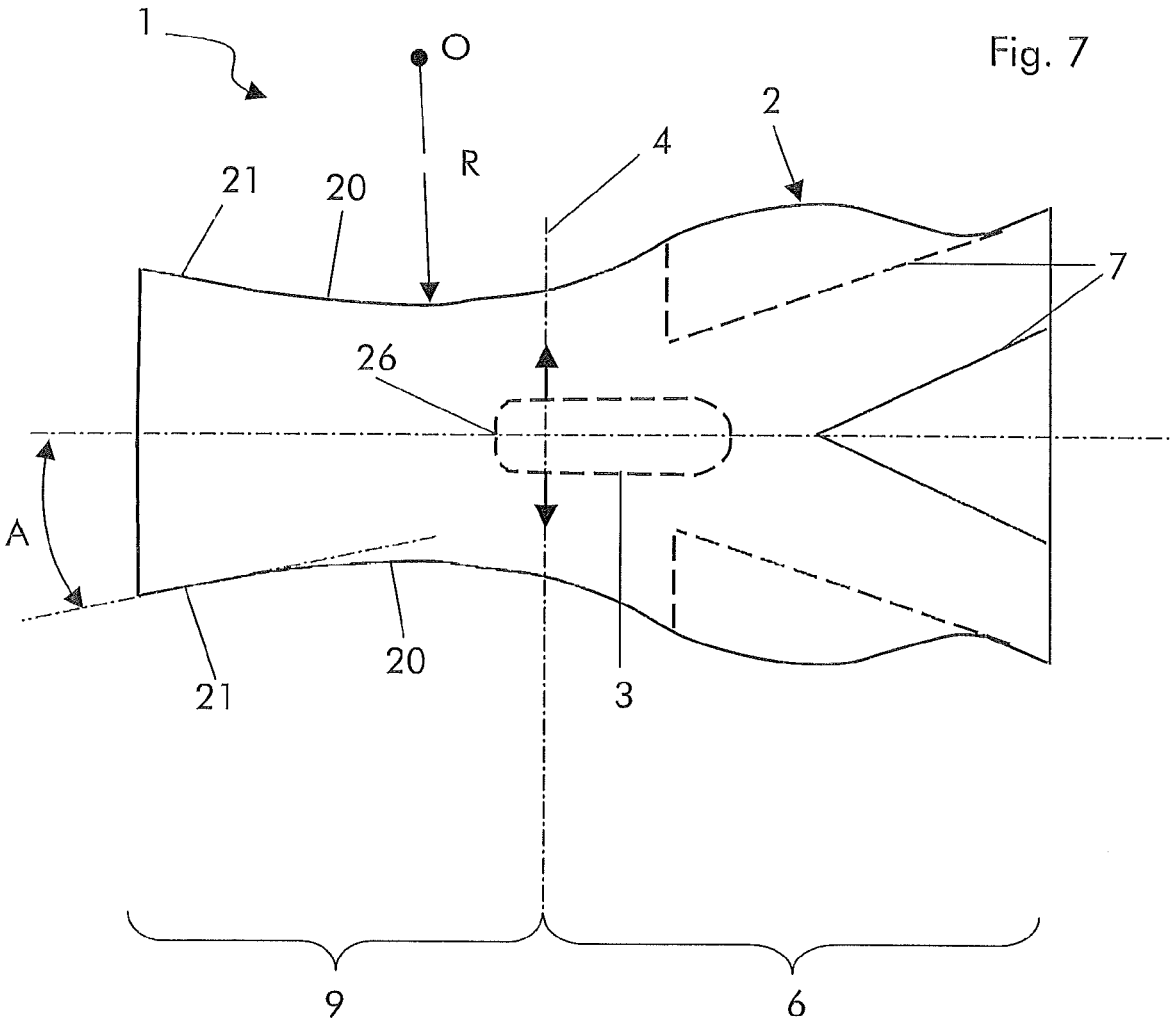
FIG. 7 is a top view of an exemplary embodiment of the disclosure.

In addition, the channel 2 can also have the mixing zone terminal portion with diverging plane side walls 21 that are downstream of and flush with the diverging side walls 20 (FIG. 7).

When provided, also the diverging plane side walls 21 define with the channel longitudinal axis 15 an angle A larger than 8 degrees and up to 15 degrees or also more.

The curved side walls 20 and the large angle A allow the hot gas velocity to be decreased without any flow separation risk, to increase the fuel/hot gas mixture residence time within the combustion chamber 12 downstream of the burner 1 and, hence, reducing for example, the CO emissions. In addition, this angle can allow a large amount of the kinetic energy of the hot gases to be converted into static pressure, such that the total pressure drop through the burner 1 is small.

In contrast, the top and bottom walls 23 of the mixing zone 9 between the diverging side walls 20 and 21 are substantially parallel with each other and can define a constant mixing zone height h. As shown, the height at the vortex generation zone 6 is larger than at the mixing zone 9.

In exemplary embodiments, the ratio between the width w at mid-height and height h of the channel cross section at the injection plane 4 can be substantially equal to 1. This feature can allow an optimised interaction between hot gases G flowing in the channel 2 and the injected fuel, leading to an improved mixing quality between hot gases G and fuel and, thus, reduced emissions (for example, $NO_x$ emissions).

Downstream of the injection plane 4 the mixing zone cross section decreases and then it increases again, defining a throat 24.

This feature can allow a high hot gas velocity through the channel 2, leading to a reduced residence time of the fuel (it is mixed with the hot gases G) in the mixing section 9 and hence reduced flashback risk and increased safety margin against flashback. The reduced flashback risk in turn can lead to reduced water consumption in fuel oil operation because it is known during fuel oil operation to mix oil with water to increase the flashback safety margin.

A lance tip 26 is located upstream of the throat 24.

This feature can ensure that the hot gas velocity increases up to a location downstream of the lance tip 26 (in the hot gas direction), preventing the flame from travelling upstream of the lance tip 26. This can further increase the safety margin against flashback.

In an exemplary embodiment, an inner wall 27 of the mixing zone 9 can have a protrusion 30 defining the line where the hot gases G detach from the wall 27.

This protrusion 30 circumferentially extends over a plane perpendicular to a channel longitudinal axis 15.

The vortex generation zone 6 has a section wherein both its width w and height h increase toward the injection plane 4 to then decrease again.

This allows a large cross section to be available for the hot gases to pass through and limits the hot gas pressure drop through the vortex generation zone 6.

FIGS. 4 through 6 show an exemplary embodiment of the burner of the disclosure.

In this exemplary embodiment, the burner 1 has the width w and height h of the vortex generation zone 6 that increases toward the injection plane 4 to then decrease again and a mixing section 9 having only the diverging curved side walls 20 (for example, no diverging plane side walls 21 are provided downstream of the curved side walls 20). For example, the angle A between the side walls 20 and the axis 15 is 16 degree.

In contrast, FIG. 7 shows an exemplary embodiment of a burner 1 having the width w and height h of the vortex generation zone 6 that increases to then decrease again. In addition, the mixing zone 9 has diverging curved side walls 20 and, downstream of them, diverging plane side walls 21. In this case, the angle A between the end of the side walls 20 and the axis 15 can be, for example, substantially 14 degrees and the plane side walls 21 can maintain substantially the same angle A can be over their whole length.

The operation of the burner of the disclosure is apparent from that described and illustrated and is substantially the following.

The hot gases G generated in a combustion chamber upstream of the burner 1 and already partially expanded in a high pressure turbine enter the channel 2 and pass through the vortex generation zone 6 where, due to the vortex generators 7, they increase their vortices and turbulence. The large cross section (due to the increasing width w and height h) allows small pressure drop.

Then, a fuel (for example, oil or a gaseous fuel) is injected into the hot gases G from the lance 3. The particular cross-section proportion of the channel 2 at the injection plane 4 can allow optimised penetration of the fuel into the core of the vortices and mixing between fuel and hot gases G. In addition, because this zone converges, the hot gases G increase their velocity, hindering flashback.

Downstream of the injection plane 4, the hot gases further increase their velocity, because the channel 2 has a converging structure. Then from the throat 24 the hot gas velocity starts to decrease, because of the diverging side walls 20.

The particular structure with curved side walls 20 (with a radius R, for example, larger than 500 millimeters) describing a circle arc in the top view can ensure that the angle A in the burners in embodiments of the disclosure can be larger than in traditional burners, because the hot gases G coming from the throat 24 with a very high velocity can gradually decrease their velocity in a much larger extent than in known burners and without any risk of flow separation.

The large velocity decrease (thus the slow velocity at the entrance of the combustion chamber 12) can allow the fuel/hot gas mixture residence time within the combustion chamber 12 to be increased and, hence, the emissions and in particular the CO emissions to be reduced.

In addition, this angle A can allow kinetic energy of the hot gases to be converted into static pressure, such that the total pressure drop through the burner is small.

When the plane side walls 21 are provided downstream of the curved side walls 20, the length of the channel 2 can be arranged to limit the curved side wall divergence and the maximum angle A to the desired amount.

Naturally the features described may be independently provided from one another.

Thus, it will be appreciated by those skilled in the art that the present invention can be embodied in other specific forms without departing from the spirit or essential characteristics thereof. The presently disclosed embodiments are therefore considered in all respects to be illustrative and not restricted.

The scope of the invention is indicated by the appended claims rather than the foregoing description and all changes that come within the meaning and range and equivalence thereof are intended to be embraced therein.

REFERENCE NUMBERS

1 burner
2 channel
3 lance
4 injection plane
6 vortex generation zone
7 vortex generator
9 mixing zone
10 side wall
11 top/bottom wall
12 combustion chamber
15 longitudinal axis of 2
20 diverging curved side walls
21 diverging plane side walls
23 top and bottom sides
24 throat
26 lance tip
27 inner wall of 9
30 protrusion
h height
w width
A angle
G hot gases
O centre of R
R radius

What is claimed is:

1. A reheat apparatus comprising:

a reheat burner comprising:

a channel with an entry for a gas flow which flows in a downstream direction; and a lance projecting into the channel and configured to inject a fuel over an injection plane perpendicular to a channel longitudinal axis, wherein the channel and the lance define a vortex generation zone upstream of the injection plane and a mixing zone downstream of the injection plane, the vortex generation zone having a converging portion in the downstream direction with vortex generators extending radially inward from the channel, the mixing zone comprising:

a diverging portion with diverging sidewalls, wherein throughout the diverging portion, a minimum distance of the diverging side walls from the channel longitudinal axis increases in the downstream direction;

wherein throughout the diverging portion, a concave surface of each diverging sidewall has a constant radius of curvature in the downstream direction.

2. The reheat apparatus as claimed in claim 1, wherein ends of the diverging side walls define with the channel longitudinal axis an angle larger than 8 degrees.

3. The reheat apparatus as claimed in claim 1, wherein the channel has a mixing zone terminal portion with plane diverging side walls downstream of the diverging side walls.

4. The reheat apparatus as claimed in claim 3, wherein the plane diverging side walls are flush with the diverging side walls.

5. The reheat apparatus as claimed in claim 4, wherein the plane diverging side walls define with the channel longitudinal axis an angle larger than 8 degrees.

6. The reheat apparatus as claimed in claim 1, wherein a width and a height of the vortex generation zone increase toward the injection plane in the 1R-et downstream direction and then decreases.

7. The reheat apparatus as claimed in claim 1, wherein at least those side walls of the mixing zone between the diverging side walls define a constant mixing zone height.

8. The reheat apparatus as claimed in claim 1, wherein a ratio between a width w at mid-height and a height h of a channel cross-section at the injection plane is equal to 1.

9. The reheat apparatus as claimed in claim 8, wherein downstream of the injection plane, a mixing zone cross-section decreases and then increases defining a throat.

10. The reheat apparatus as claimed in claim 9, wherein a lance tip is located upstream of the throat.

11. The reheat apparatus as claimed in claim 1, wherein an inner wall of the mixing zone has a protrusion defining a line where hot gases detach from the walls.

12. The reheat apparatus as claimed in claim 11, wherein the protrusion extends over a plane perpendicular to the longitudinal channel axis.

13. The reheat apparatus as claimed in claim 1, wherein the channel has a quadrangular, square or trapezoidal cross section.

14. The reheat apparatus as claimed in claim 2, wherein ends of the diverging side walls define with the channel longitudinal axis an angle larger than 15 degrees.

15. The reheat apparatus as claimed in claim 5, wherein the plane diverging side walls define with the channel longitudinal axis an angle larger than 15 degrees.

* * * * *